US008054326B2

(12) United States Patent
Endo et al.

(10) Patent No.: US 8,054,326 B2
(45) **Date of Patent: *Nov. 8, 2011**

(54) LASER EXPOSURE DEVICE AND OPTICAL AXIS ADJUSTMENT METHOD IN LASER EXPOSURE DEVICE

(75) Inventors: Takeshi Endo, Mishima (JP); Takahiro Kojima, Mishima (JP); Kazutoshi Takahashi, Sunto-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 230 days.

This patent is subject to a terminal disclaimer.

(21) Appl. No.: 12/477,961

(22) Filed: Jun. 4, 2009

(65) Prior Publication Data

US 2009/0238605 A1 Sep. 24, 2009

Related U.S. Application Data

(63) Continuation of application No. 11/675,421, filed on Feb. 15, 2007, now Pat. No. 7,557,821.

(30) Foreign Application Priority Data

Feb. 20, 2006 (JP) ..... 2006-043115

(51) Int. Cl.
*B41J 2/44* (2006.01)

(52) U.S. Cl. ..... 347/242

(58) Field of Classification Search ..... 347/241–245, 347/256–258
See application file for complete search history.

(56) References Cited

U.S. PATENT DOCUMENTS 6,384,950 B1 * 5/2002 Saito et al. ..... 359/196.1
7,342,600 B2 3/2008 Nakano
7,557,821 B2 * 7/2009 Endo et al. ..... 347/242

FOREIGN PATENT DOCUMENTS

JP 2000-314844 11/2000

* cited by examiner

*Primary Examiner* — Huan Tran
(74) *Attorney, Agent, or Firm* — Turocy & Watson, LLP

(57) ABSTRACT

In a laser exposure device according to the present invention, a positioning pin, which is formed in a lens holder supporting a lens system, is inserted through an elongated hole for restriction of a board holder supporting a laser diode. An eccentric cam is inserted into an elongated hole for rotation movement formed in a board holder and a circular hole for rotation movement which is formed in the lens holder and which faces the elongated hole for rotation movement. An eccentric cam is inserted into an elongated hole for slide movement formed in the board holder and a circular hole for slide movement which is formed in the lens holder and which faces the elongated hole for slide movement. The eccentric cams are rotated to relatively move the board holder and lens holder with respect to each other to thereby establish alignment between the optical axes of the laser diode and lens system. In a state where the eccentric cams are fitted into the elongated holes, the board holder and lens holder are fixed to each other by screws.

20 Claims, 7 Drawing Sheets

LASER EXPOSURE DEVICE AND OPTICAL AXIS ADJUSTMENT METHOD IN LASER EXPOSURE DEVICE

CROSS REFERENCE TO RELATED APPLICATIONS

This application claims the benefit of priority from and is a Continuation of application Ser. No. 11/675,421 filed on Feb. 15, 2007, which is based upon and claims the benefit of priority from prior Japanese Patent Application No. 2006-43115 filed on Feb. 20, 2006, the entire contents of both of which are incorporated herein by reference.

BACKGROUND OF THE INVENTION

1. Field of the Invention

The present invention relates to a laser exposure device and an optical axis adjustment method in the laser exposure device that adjust the positional relationship between a light source and a lens system of the exposure device or the positional relationship between laser light that has passed through the lens system and a sensor in an electro photographic type copier or printer that uses laser light to perform exposure to thereby obtain an image.

2. Description of the Related Art

As an electrophotographic type image forming apparatus, there is recently known an apparatus that uses laser light from a laser exposure device using a laser light-emitting element as a light source to exposure a photoconductor to thereby obtain an electrostatic latent image on the photoconductor. The laser exposure device using the laser light-emitting element as a light source includes a lens system for focusing the laser light onto a deflector such as a polygon mirror. The laser light-emitting element and a drive circuit therefor are generally supported by a laser holder, and the lens system is mounted on the lens holder. In the laser exposure device, the positional relationship between the laser light-emitting element and lens system need to be adjusted for their optical axes to be in alignment with each other. Further, in the laser exposure device, the positional adjustment needs to be carried out so that a beam detector (BD) for obtaining horizontal synchronous based on which the write start position of the laser light on the photoconductor is determined is in alignment with the optical axis of the laser light that has passed through the lens system.

Therefore, a mechanism that adjusts the positional relationship between the optical axes of the laser light-emitting element and lens system while freely moving laser and lens holders in X and Y directions is provided in a conventional laser exposure device. That is, a needle mounted on a precision stage which is movable in X and Y directions is used to press the laser holder to the lens holder to scrub the two holders against each other for positional adjustment. After the positional adjustment, while the needle is tightly pressed to the two holders for preventing the holders from being displaced from each other as a screw for fixing the two holders is fastened in a stepwise manner.

Further, another mechanism for positional adjustment is known. In the case where a laser exposure device includes, e.g., three optical devices in an image forming apparatus, the mechanism first fixes the position of the two optical devices and then fixes the position of the residual third optical device to complete the fixation of the positions of all the optical devices. This mechanism is disclosed in, for example, Jpn. Pat. Publication (Kokai) No. 2000-314844.

However, in the former adjustment method, since a screw is fastened in a stepwise manner while confirming that the two holders are not displaced from each other, it takes long time for fixing operation and for the entire positional adjustment. Further, in order to move the two holders with high accuracy by scrubbing them against each other, it is necessary to restrict the movement range as much as possible, so that a through hole for receiving the needle needs to be formed in the laser holder at the position in the vicinity of the laser light-emitting element, which places restraint on the wiring of a drive circuit in the vicinity of the laser light-emitting element.

Therefore, it is desirable to provide a laser exposure device and an optical axis adjustment method in the laser exposure device, capable of preventing the laser holder and lens holder from being displaced from each other or preventing misalignment between the optical axis of the laser light and BD, reducing time for the fixing operation after the positional adjustment, and improving the flexibility of the wiring of the drive circuit in the vicinity of the laser light-emitting element.

SUMMARY OF THE INVENTION

An aspect of the present invention is to provide a laser exposure device and an optical axis adjustment method in the laser exposure device, capable of reducing time for the fixing operation after the positional adjustment between the lens system and laser light-emitting element or laser receiving element and improving the flexibility of the wiring of the drive circuit in the vicinity of the laser light-emitting element, having a high productivity, and having a high design flexibility.

According to an embodiment of the present invention, there is provided a laser exposure device comprising: a laser light source; a lens system which guides laser light emitted from the laser light source to a predetermined position; a light source board which supports the laser light source; a lens board which supports the lens system; a restricting member which joins the light source board and lens board such that they can relatively be moved with respect to each other in a first direction; an elongated hole for rotation movement which is formed in the light source board or lens board at the position on the extension of the center line connecting the center of the restricting member and that of the laser light source and whose long side extends in parallel to the center line; a circular hole for rotation movement which is formed in the light source board or lens board at the position facing the elongated hole for rotation movement and whose diameter is smaller than the length of the short side of the elongated hole for rotation movement; an elongated hole for slide movement which is formed in the light source board or lens board and whose short side extends along the first direction; and a circular hole for slide movement which is formed in the light source board or lens board at the position facing the elongated hole for slide movement and whose diameter is smaller than the length of the short side of the elongated hole for slide movement.

DETAILED DESCRIPTION OF THE INVENTION

Figure 1:
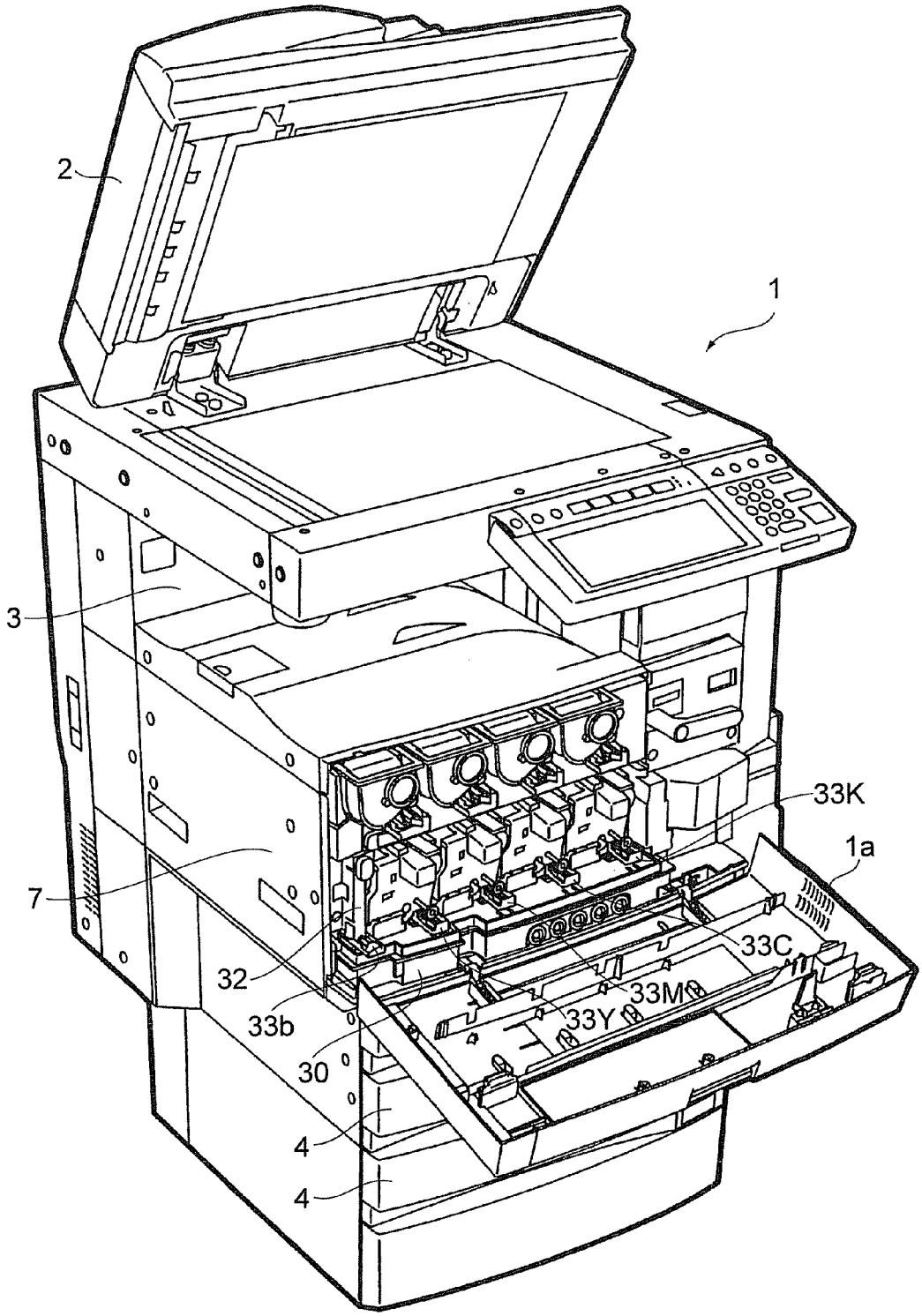
FIG. 1 is a perspective view showing the appearance of a color copier according to a first embodiment of the present invention in a state where a front cover thereof is opened.
Figure 2:
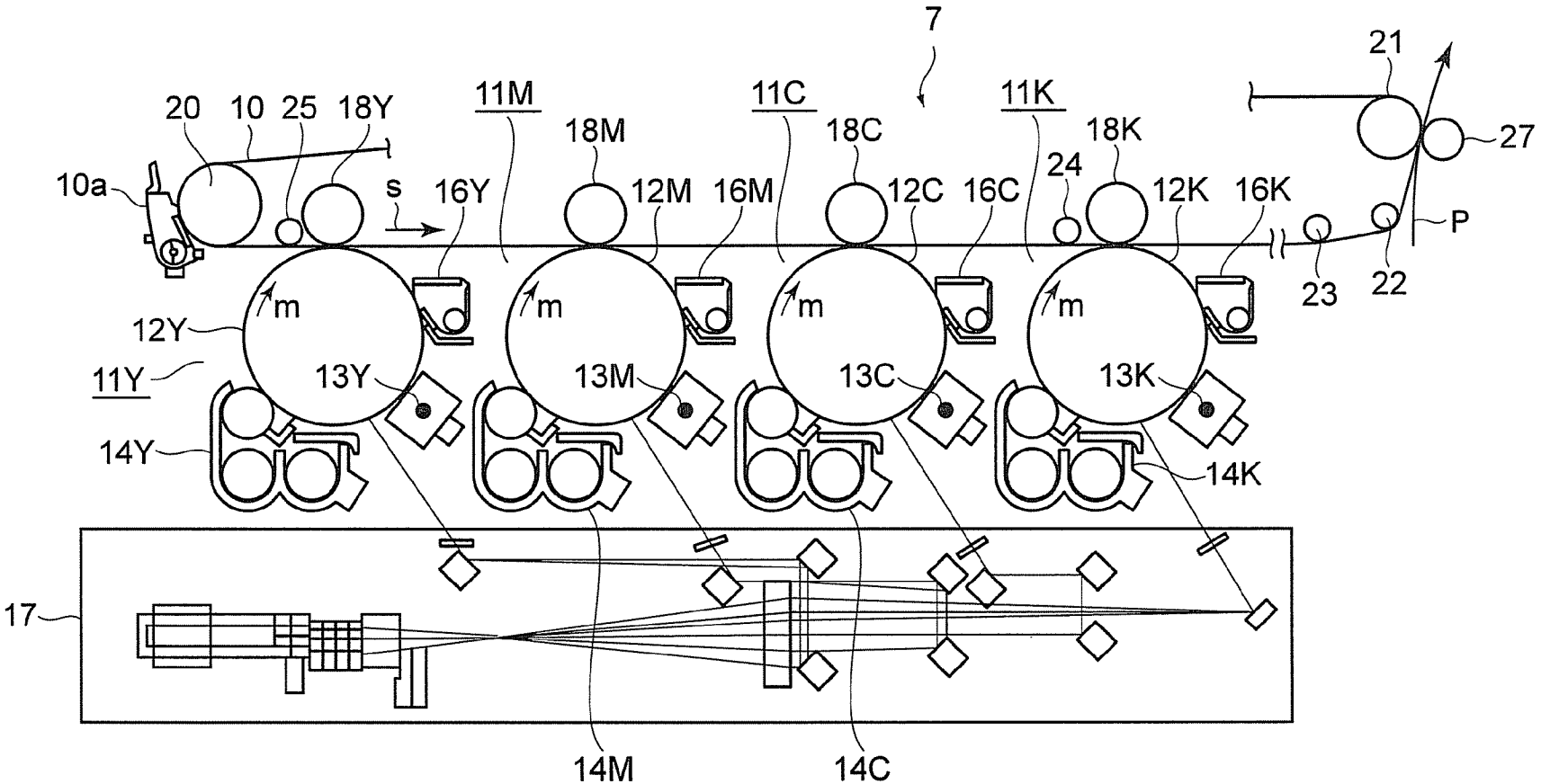
FIG. 2 is an explanatory view schematically showing an image forming section according to the first embodiment of the present invention.

Hereinafter, a first embodiment of the present invention will be described in detail with reference to the accompanying drawings. FIG. 1 is a perspective view showing a four-drum tandem color copier 1 which is an image forming apparatus according to the first embodiment of the present invention in a state where a front cover 1*a* which is a cover of the color copier 1 is opened, and FIG. 2 is a view schematically showing a configuration of an image forming section 7 of the color copier 1. The color copier 1 has, at its upper portion, a scanner section 2 and an inter-body sheet eject section 3. The color copier 1 further includes four image forming units 11Y (yellow), 11M (magenta), 11C (cyan), 11K (black) which are arranged in parallel along the lower side of an intermediate transfer belt 10 which is an endless belt member.

The image forming units 11Y, 11M, 11C, 11K have photoconductor drums 12Y, 12M, 12C, 12K, respectively, as an image carrier. Around the photoconductor drums 12Y, 12M, 12C, 12K, electrification chargers 13Y, 13M, 13C, 13K, and development units 14Y, 14M, 14C, 14K, and photoconductor drum cleaning units 16Y, 16M, 16C, 16K are respectively provided along the rotation direction (denoted by arrow m) of the photoconductor drums 12Y, 12M, 12C, 12K. Exposed lights emitted from a laser exposure device 17 are each passed between the electrification chargers 13Y, 13M, 13C, 13K and development units 14Y, 14M, 14C, 14K and irradiated onto the surfaces of the photoconductor drums 12Y, 12M, 12C, 12K, respectively.

The electrification chargers 13Y, 13M, 13C, 13K uniformly charge the entire surfaces of the photoconductor drums 12Y, 12M, 12C, 12K to about −700V. The development units 14Y, 14M, 14C, 14K supply the photoconductor drums 12Y, 12M, 12C, 12K with two component developers each comprising a toner (of yellow (Y), magenta (M), cyan (C), or black (K)) and a carrier.

The laser exposure device 17 uses a polygon mirror 121 to scan laser beams emitted from a plurality of laser diodes 117 of yellow (Y), magenta (M), cyan (C), and black (K) in the axial line directions of the photoconductor drums 12Y, 12M, 12C, 12K. The laser beams thus scanned are passed through a focusing lens system 122 and focused on the respective photoconductor drums 12Y, 12M, 12C, 12K.

The intermediate transfer belt 10 is made of, e.g., semi-electrically conductive polyimide which is a relatively stable material in terms of heat resistance and abrasion resistance. The intermediate transfer belt 10 is wound around a drive roller 21, a driven roller 20, and first to fourth tension rollers 22 to 25. Primary transfer voltage is applied by primary transfer rollers 18Y, 18M, 18C, 18K respectively to transfer primarily positions of the intermediate transfer belt 10 opposite to the photoconductor drums 12Y, 12M, 12C, 12K to allow toner images on the photoconductor drums 12Y, 12M, 12C, 12K to be transferred primarily onto the intermediate transfer belt 10. The photoconductor cleaning units 16Y, 16M, 16C, 16*k* collect residual toner on the photoconductor drums 12Y, 12M, 12C, 12K as waste toner after the end of the primary transfer.

At a secondary transfer position of the intermediate transfer belt 10, which is supported by the drive roller 21, a secondary transfer roller 27 is disposed opposite to the drive roller 21. At the secondary transfer position, the secondary transfer roller 27 applies secondary transfer voltage to a toner image on the intermediate transfer belt 10 through a sheet P or the like fed from a sheet feeder section 4. As a result, the toner image on the intermediate transfer belt 10 is transferred secondarily onto the sheet P. A belt cleaner 10*a* is disposed opposite to the driven roller 20 at the position on the downstream side of the intermediate transfer belt 10 with respect to the secondary transfer roller 27 in such a manner that it can contact or separate from the intermediate transfer belt 10. The belt cleaner 10*a* collects residual toner on the intermediate transfer belt 10 as waste toner after the end of the secondary transfer.

The residual toner collected by the photoconductor cleaning units 16Y, 16M, 16C, 16*k* and belt cleaner 10*a* is stored in a waste toner box 30. The waste toner box 30 extends in an elongated manner on the front side of the image forming section 7 of the color copier 1. When the waste toner box 30 is filled with the toner, it is exchanged for a new toner box.

Figure 3:
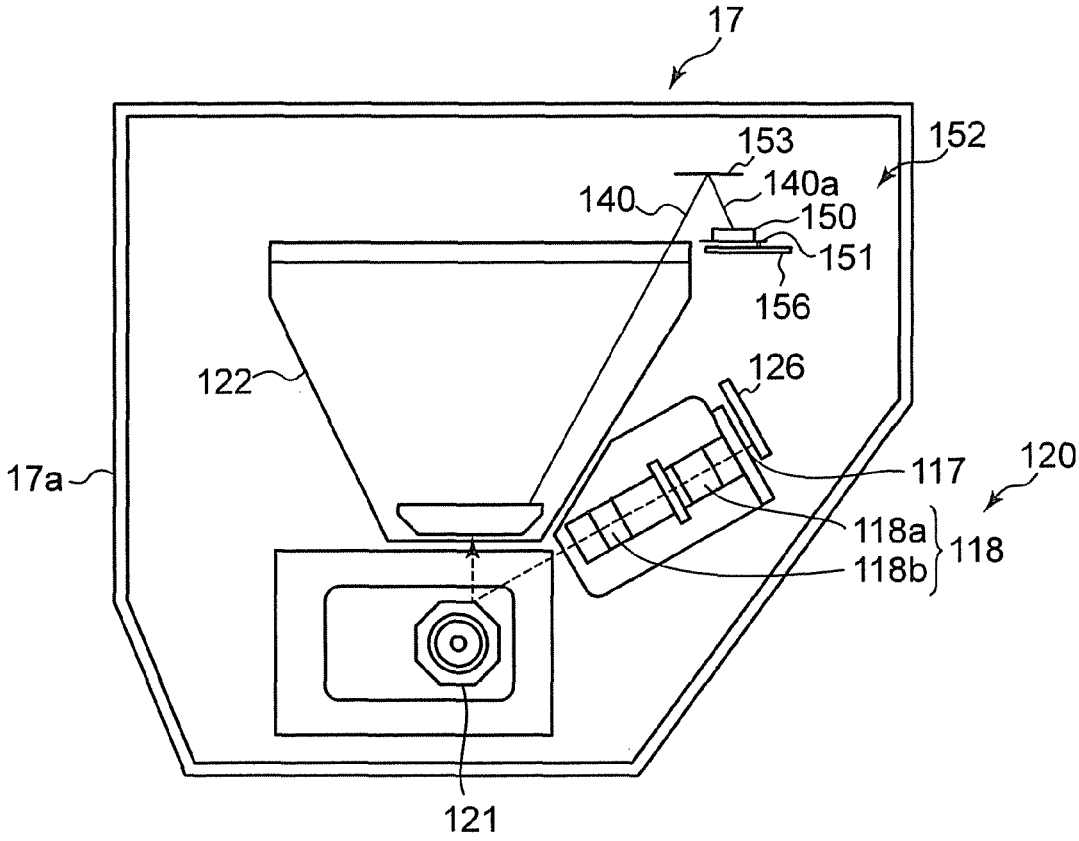
FIG. 3 is an explanatory view showing an example in which a light source unit according to the first embodiment has been mounted on a laser exposure device.

A description will next be made of the light source unit 120 for use in the laser exposure device 17. For simplifying the explanation, FIG. 3 shows the laser exposure device 17 having one light source unit 120, for example. The laser exposure device 17 carries, in a housing 17*a*, the light source unit 120 which includes a laser diode 117 serving as a laser light source and a lens system 118 having a finite focal lens 118*a* and a cylindrical lens 118*b*.

The laser exposure device 17 further includes the polygon mirror 121 that scans laser light emitted from the laser diode 117 in the axial direction of the photoconductor drums 12Y, 12M, 12C, 12K and focusing lens system 122 that focuses the laser light onto the photoconductor drums 12Y, 12M, 12C, 12K. Further, the laser exposure device 17 carries a detection unit 152 having a BD (Beam Detector) 150 which is a laser receiving element for obtaining horizontal synchronous. Based on the horizontal synchronous the write start position of the laser light on the photoconductor drums 12Y, 12M, 12C, 12K is determined.

Figure 4:
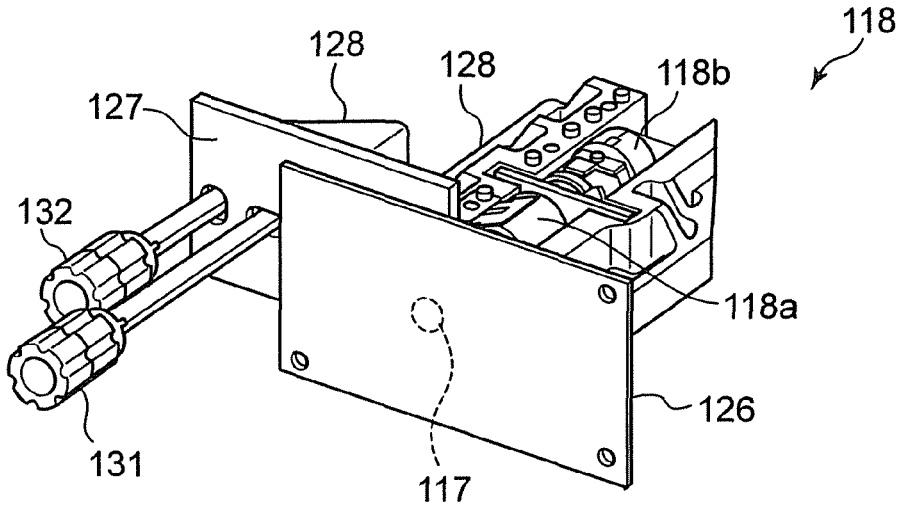
FIG. 4 is a perspective view schematically showing a state where an adjustment tool has been inserted into the light source unit according to the first embodiment of the present invention.
Figure 5:
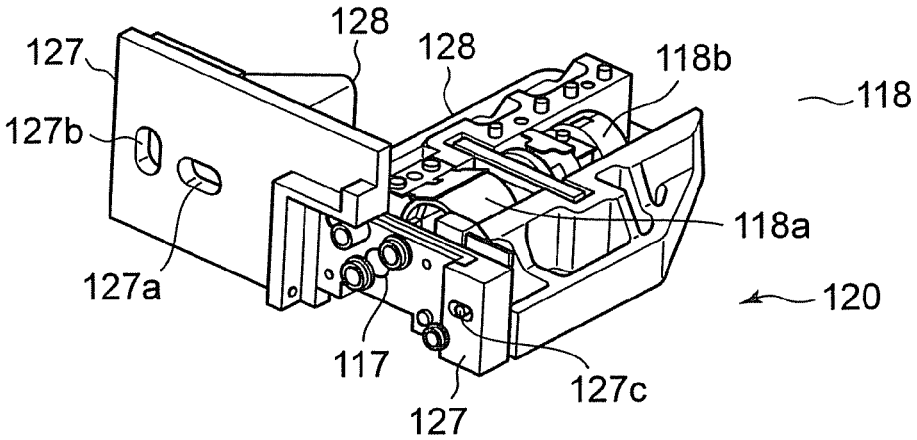
FIG. 5 is a perspective view schematically showing a board holder and a lens system according to the first embodiment of the present invention.
Figure 6:
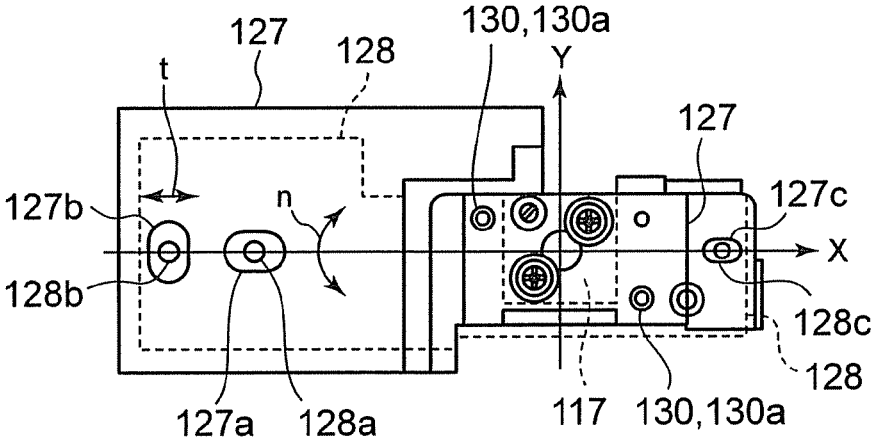
FIG. 6 is an explanatory view schematically showing the movement direction of the board holder and lens holder according to the first embodiment of the present invention.
Figure 7:
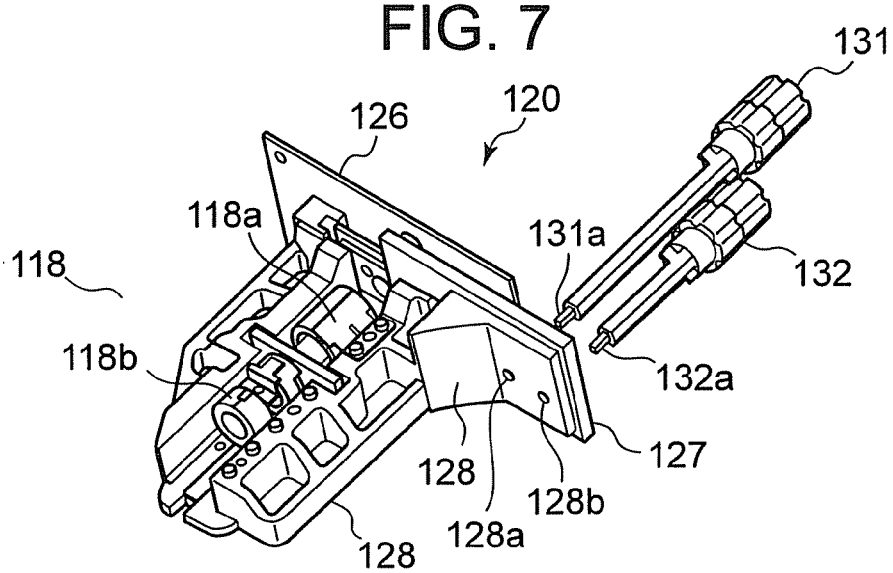
FIG. 7 is a perspective view schematically showing the light source unit according to the first embodiment of the present invention.

After the positional relationship between the laser diode 117 and lens system 118 is adjusted at the production time, the light source unit 120 is fixed. As shown in FIG. 4, the laser diode 117 is provided at substantially the center of a circuit board 126. The circuit board 126 is supported by a board holder 127 shown in FIG. 5 and is movable in the directions of X-axis and Y-axis shown in FIG. 6. The circuit board 126 and board holder 127 constitute a light source board which is a second board. The lens system 118 is supported by a lens holder 128 constituting a first board denoted by the dotted line in FIG. 6 and is movable in the X-axis and Y-axis directions.

In the board holder 127, a first elongated hole 127*a* which is an elongated hole for rotation movement to be used for position adjustment, a second elongated hole 127*b* which is an elongated hole for slide movement, and an elongated hole for restriction 127*c* are formed. In the lens holder 128, a first circular hole 128*a* which is a circular hole for rotation movement to be used for position adjustment, a second circular hole 128*b* which is a circular hole for slide movement and a positioning pin 128*c* are formed. The positioning pin 128*c* has a diameter corresponding to the short side of the elongated hole for restriction 127*c* and is inserted through the elongated hole for restriction 127*c*. The positioning pin 128*c* is movable in the X-axis direction shown in FIG. 6 which is a first direction and direction of the long side of the elongated hole for restriction 127*c*. The elongated hole for restriction 127*c* and positioning pin 128*c* constitute a restriction member that allows the board holder 127 and lens holder 128 to be moved relative to each other.

The first elongated hole 127*a* of the board holder 127 exists on the extension of the center line (X-axis in FIG. 6) connecting the center of the positioning pin 128*c* to be inserted through the elongated hole for restriction 127*c* and the center of the laser diode 117 and has a long side parallel to the center line (extending in X-axis direction). The second elongated hole 127*b* is formed such that its short side extends in the first direction (X-axis direction in FIG. 6).

When the board holder 127 and lens holder 128 are overlapped with each other, the first circular hole 128*a* of the lens holder 128 faces the first elongated hole 127*a* of the board holder 127. When the board holder 127 and lens holder 128 are overlapped with each other, the second circular hole 128*b* of the lens holder 128 faces the second elongated hole 127*b* of the board holder 127. The diameter of the first circular hole 128*a* is smaller than the length of the short side of the first elongated hole 127*a*. The diameter of the second circular hole 128*b* is smaller than the length of the short side of the second elongated hole 127*b*.

Figure 10A:
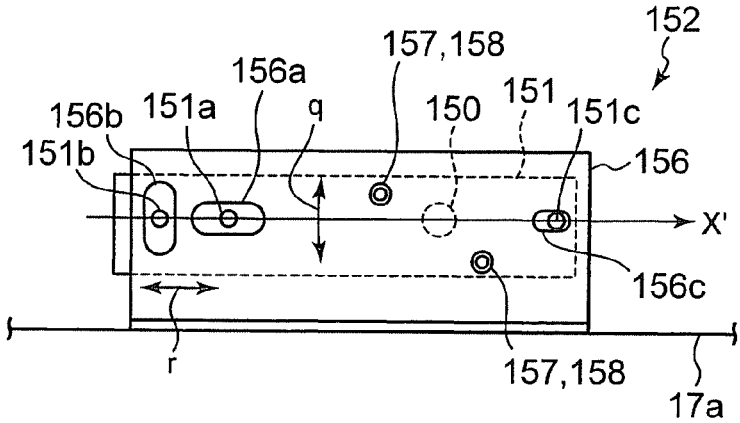
FIG. 10A is an explanatory view schematically showing the movement direction of a fixed base plate and a light receiving board according to the first embodiment of the present invention.
Figure 10B:
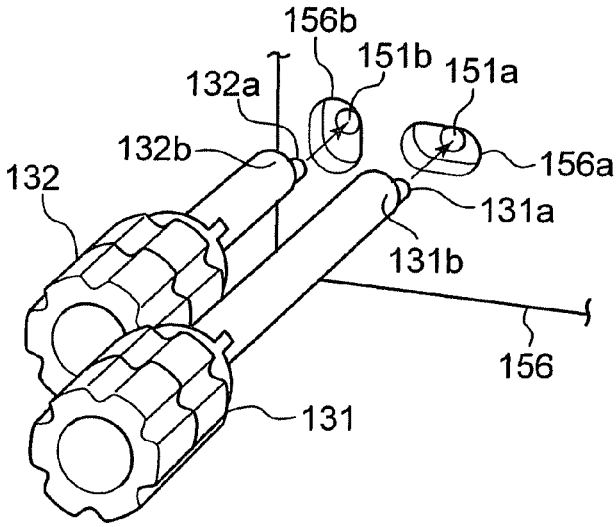
FIG. 10B is an explanatory view showing the adjustment tool, fixed base plate, and light receiving board according to the first embodiment of the present invention.
Figure 10C:
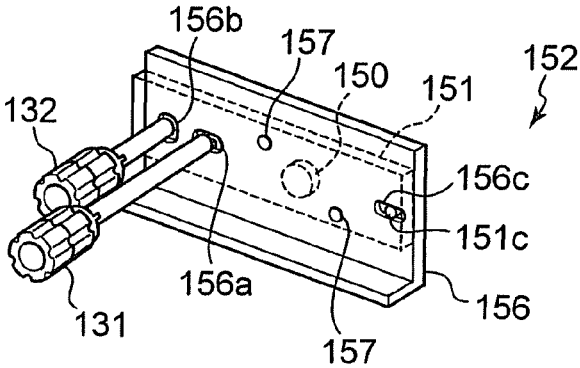
FIG. 10C is a perspective view schematically showing a state where the adjustment tool has been inserted into a detection unit according to the first embodiment of the present invention.

The BD 150 of the detection unit 152 detects reflected light 140*a* which is obtained by reflecting laser light 140 to be irradiated onto the respective photoconductor drums 12Y, 12M, 12C, 12K by a mirror 153. After the position of a light-receiving board 151 which is a second board for supporting the BD 150 is adjusted to establish alignment between the optical axis of the reflected light 140*a* and BD 150 at the production time, the detection unit 152 is fixed. The detection unit 152 is, as shown in FIGS. 10A, 10B and 10C, a first board and has a fixed board 156 to be fixed to the housing 17*a* like the light source unit 120. That is, the fixed board 156 is integrated with the light source unit 120 through the housing 17*a*.

In the fixed board 156, a seventh elongated hole 156*a* which is an elongated hole for rotation movement to be used for position adjustment, an eighth elongated hole 156*b* which is an elongated hole for slide movement, and an elongated hole for restriction 156*c* are formed. In the light-receiving board 151, a seventh circular hole 151*a* which is a circular hole for rotation movement to be used for position adjustment, an eighth circular hole 151*b* which is a circular hole for slide movement, and a positioning pin 151*c* are formed. The positioning pin 151*c* has a diameter corresponding to the short side of the elongated hole for restriction 156*c* and is inserted through the elongated hole for restriction 156*c*. The positioning pin 151*c* is movable in the X'-axis direction shown in FIG. 10A which is a first direction and direction of the long side of the elongated hole for restriction 156*c*. The elongated hole for restriction 156*c* and positioning pin 151*c* constitute a second restriction member that allows the fixed board 156 and light-receiving board 151 to be moved relative to each other.

The seventh elongated hole 156*a* of the fixed board 156 exists on the extension of the center line (X'-axis in FIG. 10A) connecting the center of the positioning pin 151*c* to be inserted through the elongated hole for restriction 156*c* and the center of the BD 150 and has a long side parallel to the center line (extending in X'-axis direction). The eighth elongated hole 156*b* is formed such that its short side extends in the first direction (X'-axis direction in FIG. 10A).

When the fixed board 156 and light-receiving board 151 are overlapped with each other, the seventh circular hole 151*a* of the light-receiving board 151 faces the seventh elongated hole 156*a* of the fixed board 156. When the fixed board 156 and light-receiving board 151 are overlapped with each other, the eighth circular hole 151*b* of the light-receiving board 151 faces the eighth elongated hole 156*b* of the fixed board 156. The diameter of the seventh circular hole 151*a* is smaller than the length of the short side of the seventh elongated hole 156*a*. The diameter of the eighth circular hole 151*b* is smaller than the length of the short side of the eighth elongated hole 156*b*.

Figure 8:
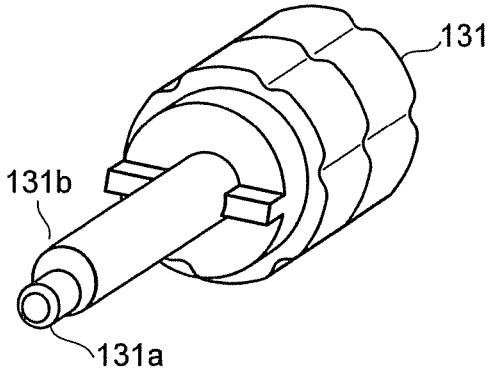
FIG. 8 is a perspective view schematically showing a first adjustment tool according to the first embodiment of the present invention.
Figure 9:
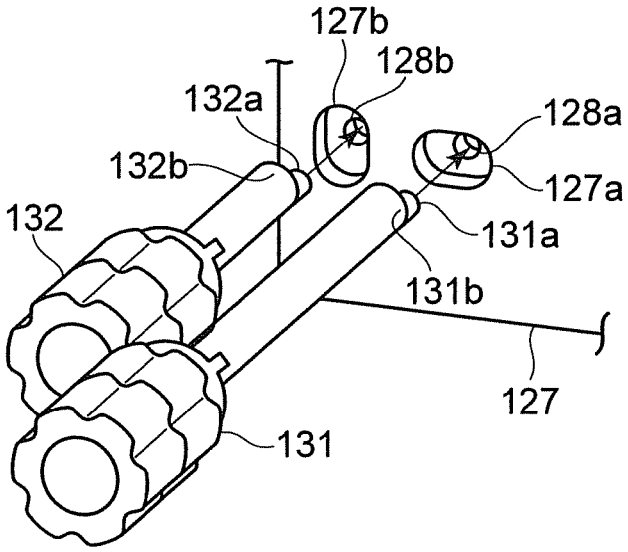
FIG. 9 is an explanatory view showing the adjustment tool, board holder, and lens holder according to the first embodiment of the present invention.
Figure 11:
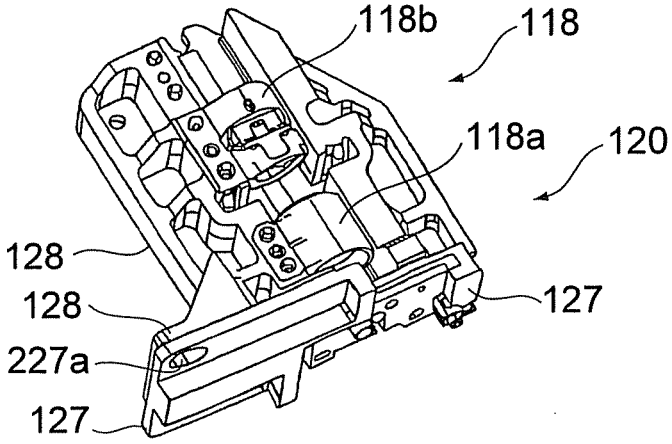
FIG. 11 is a perspective view showing a light source unit according to a second embodiment of the present invention.

A description will next be made of adjustment operation of the position of the light source unit 120. Firstly, the positioning pin 128*c* is inserted through the elongated hole for restriction 127*c*. Then the board holder 127 and lens holder 128 are overlapped with each other such that the first circular hole 128*a* and second circular hole 128*b* of the lens holder 128 face the first elongated hole 127*a* and second elongated hole 127*b* of the board holder 127, respectively. After that, first and second adjustment tools 131 and 132 shown in FIGS. 8 and 9 are used to perform the position adjustment.

An eccentric cam 131*b* having a cylinder 131*a* as a rotary shaft is formed at the distal end of the first adjustment tool 131. The cylinder 131*a* is configured to be inserted into the first circular hole 128*a*. Accordingly, the eccentric cam 131*b* is inserted into the first elongated hole 127*a*. When the eccentric cam 131*b* is inserted into the first elongated hole 127*a* and is rotated, it is brought into contact with the side of the first elongated hole 127*a* to allow the board holder 127 to be moved in the Y-axis direction. The distal end of the second adjustment tool 132 has the same configuration as that of the first adjustment tool 131. A cylinder 132*a* at the distal end of the second adjustment tool 132 is configured to be inserted into the second circular hole 128*b*. Accordingly, an eccentric cam 132*b* is inserted into the second elongated hole 127*b*. When the eccentric cam 132*b* is inserted into the second elongated hole 127*b* and is rotated, it is brought into contact with the side of the second elongated hole 127*b* to allow the board holder 127 to be moved in the X-axis direction.

After the board holder 127 and lens holder 128 are overlapped with each other, the first adjustment tool 131 is inserted into the first elongated hole 127*a* and second adjustment tool 132 is inserted into the second elongated hole 127*b*. More specifically, the cylinder 131*a* of the first adjustment tool 131 is inserted into the first circular hole 128*a* to insert the eccentric cam 131*b* into the first elongated hole 127*a* and, similarly, the cylinder 132*a* of the second adjustment tool 132 is inserted into the second circular hole 128*b* to insert the eccentric cam 132*b* into the second elongated hole 127*b*.

Subsequently, the first and second adjustment tools 131 and 132 are rotated to establish alignment between the optical axes of the laser diode 117 and lens system 118. That is, when the first adjustment tool 131 is rotated, the eccentric cam 131*b* is rotated about the cylinder 131*a* and is brought into contact with the side of the first elongated hole 127*a*. As a result, the board holder 127 and lens holder 128 are relatively rotated about the positioning pin 128*c* with respect to each other in the directions of arrow n shown in FIG. 6.

When the second adjustment tool 132 is rotated, the eccentric cam 132*b* is rotated about the cylinder 132*a* and is brought into contact with the side of the second elongated hole 127*b*. As a result, the board holder 127 and lens holder 128 are relatively moved with respect to each other in the directions along X-axis which are denoted by arrow t shown in FIG. 6. At this time, the elongated hole for restriction 127*c* and positioning pin 128*c* are relatively moved with respect to each other in the directions along X-axis. The rotational operation of the first and second adjustment tools 131 and 132 may be performed alternately or simultaneously.

The first and second adjustment tools 131 and 132 are rotated as described above to thereby establish alignment between the optical axes of the laser diode 117 and lens system 118. After the alignment between the optical axes of the laser diode 117 and lens system 118 has been established, screws 130*a* are tightened in screw holes 130 to thereby fix the board holder 127 and lens holder 128 together. In this state, the positional relationship between the board holder 127 and lens holder 128 is determined by three points: the positioning pin 128*c*, first adjustment tool 131, and second adjustment tool 132. This prevents the positions of the board holder 127 and lens holder 128 from being displaced at the time of screwing them, thereby completing the screwing operation quickly. Actually, the time needed for the adjustment and fixation of the optical axis of the light source unit 120 has been significantly reduced to about 1 minute, while it takes about 1.5 minute in a conventional unit using the needle. After that, the light source unit 120 is incorporated and fixed in the housing 17*a*.

Subsequently, the position of the detection unit 152 is adjusted. Firstly, the positioning pin 151*c* of the light-receiving board 151 is inserted through the elongated hole for restriction 156*c* of the fixed board 156. Then the fixed board 156 and light-receiving board 151 are overlapped with each other such that the seventh elongated hole 156*a* and eighth elongated hole 156*b* of the fixed board 156 face the seventh circular hole 151*a* and eighth circular hole 151*b* of the light-receiving board 151, respectively. After that, first and second adjustment tools 131 and 132 shown in FIG. 10A are used to perform the position adjustment, as in the case of the position adjustment of the light source unit 120 described above.

After the fixed board 156 and light-receiving board 151 are overlapped with each other, the first adjustment tool 131 is inserted into the seventh elongated hole 156*a* and second adjustment tool 132 is inserted into the eighth elongated hole 156*b*. More specifically, the cylinder 131*a* of the first adjustment tool 131 is inserted into the seventh circular hole 151*a* to insert the eccentric cam 131*b* into the seventh elongated hole 156*a* and, similarly, the cylinder 132*a* of the second adjustment tool 132 is inserted into the eighth circular hole 151*b* to insert the eccentric cam 132*b* into the eighth elongated hole 156*b*.

Subsequently, the first and second adjustment tools 131 and 132 are rotated to establish alignment between the optical axis of the reflected light 140*a* and BD 150. That is, when the first adjustment tool 131 is rotated, the light-receiving board 151 is rotated about the positioning pin 151*c* in the direction of arrow q shown in FIG. 10A. When the second adjustment tool 132 is rotated, the light-receiving board 151 is moved in the direction along X'-axis denoted by arrow r shown in FIG. 10A. At this time, the elongated hole for restriction 156*c* and positioning pin 151*c* are relatively moved with respect to each other in the directions along X'-axis. The rotational operation of the first and second adjustment tools 131 and 132 may be performed alternately or simultaneously.

The first and second adjustment tools 131 and 132 are rotated as described above to thereby establish alignment between the optical axis of the reflected light 140*a* and BD 150. After the alignment between the optical axis of the reflected light 140*a* and BD 150 has been established, screws 157 are tightened in screw holes 158 to thereby fix the light-receiving board 151 to the fixed board 156. In this state, the positional relationship between the light-receiving board 151 and fixed board 156 is determined by three points: the positioning pin 151*c*, first adjustment tool 131, and second adjustment tool 132. This prevents the position of the light-receiving board 151 from being displaced with respect to the fixed board 156 at the time of screwing them, thereby completing the screwing operation quickly.

When an image forming process is started in the color copier 1 carrying the laser exposure device 17 having the configuration described above, image information is input from a scanner or an information terminal such as a PC, the photoconductor drums 12Y, 12M, 12C, 12K are rotated, and the image formation process is sequentially carried out in the image forming units 11Y, 11M, 11C, 11K. In the image forming unit 11Y of yellow (Y), the surface of the photoconductor drum 12Y is uniformly charged by the electrification charger 13Y.

Subsequently, the photoconductor drum 12Y is irradiated with laser light corresponding to image information corresponding to the image information of yellow (Y) at an exposure position 17Y, and an electrostatic latent image is formed. Furthermore, a toner image is formed by the development unit 14Y, and photoconductor drum 12Y makes contact with the intermediate transfer belt 10 rotating in the direction of arrow s and transfers primarily the toner image onto the intermediate transfer belt 10 by the primary transfer roller 18Y.

Similarly to the toner image forming process of yellow (Y), the toner image forming process of magenta (M), cyan (C), and black (K) is performed. Toner images formed on the photoconductor drums 12M, 12C, and 12K are transferred sequentially on the intermediate transfer belt 10 as that where the toner image of yellow (Y) is formed. As a result, a full-color toner image obtained by executing multiple-transfer of yellow (Y), magenta (M), cyan (C) and black (K) is formed on the intermediate transfer belt 10.

Then the full-color toner image formed on the intermediated transfer belt 10 reaches the position of the secondary transfer roller 27, and is transferred secondarily onto a sheet P in a batch by a transfer bias of the secondary transfer roller 27. Thereafter, the sheet P is processed at a fixing step and the full-color toner image is completed. In the case of a single-sided printing, the sheet P is directly ejected to the inter-body sheet eject section 3. In the case of a double-sided printing or multiple printing, the sheet P is fed once again to the position of the secondary transfer roller 27 through a refeeding unit (not shown).

After the end of the secondary transfer, residual toner on the intermediate transfer belt 10 is cleaned by the belt cleaner 10*a*. Further, the photoconductor drums 12Y, 12M, 12C, 12K transfer primarily the toner images to the intermediate transfer belt 10, and then residual toners thereon are removed by the photoconductor drum cleaning units 16Y, 16M, 16C, 16K for the next image forming process.

The belt cleaner 10*a* uses a cleaning blade 50 pressedly contacting the intermediate transfer belt 10 to collect waste toner from the intermediate transfer belt 10 and feeds the waste toner using an auger 51 to the front side. The waste toner is then discharged in a waste toner box 30 and stored therein.

According to the first embodiment, in a state where the board holder 127 and lens holder 128 are joined to each other by the elongated hole for restriction 127*c* and positioning pin 128*c*, the first adjustment tool 131 is inserted into the first elongated hole 127*a* and is rotated therein. As a result, the board holder 127 and lens holder 128 are relatively rotated about the positioning pin 128*c* with respect to each other. Further, the second adjustment tool 132 is inserted into the second elongated hole 128*a* and is rotated therein. As a result, the board holder 127 and lens holder 128 are relatively moved with respect to each other in the directions along X-axis.

Thereafter, at the time point when the board holder 127 and lens holder 128 are to be fixed to each other, the positional relationship between the board holder 127 and lens holder 128 is determined by three points: the positioning pin 128*c*, first adjustment tool 131, and second adjustment tool 132. This prevents the positions of the board holder 127 and lens holder 128 from being displaced at the time of screwing them, thereby completing the screwing operation quickly. As a result, it is possible to reduce the time needed for the adjustment and fixation of the optical axis of the light source unit 120 as compared to conventional approaches. Further, there is no need to form a hole for adjustment in the circuit board 126 at the position in the vicinity of the laser diode 117, which has been necessary for conventional approaches. This eliminates the limitation on the design of the drive circuit of the laser diode 117, thereby increasing design flexibility.

Further, after the light source unit 120 is fixed to the housing 17*a*, the first and second adjustment tools 131 and 132 are used to rotate the light-receiving board 151 relative to the fixed board 156 and slide the light-receiving board 151 in the X'-axis direction. After that, screws are used to fix the light-receiving board 151 and fixed board 156 in a state where the positional relationship between the light-receiving board 151 and fixed board 156 is determined by the first adjustment tool 131, second adjustment tool 132, and positioning pin 151*c*. This prevents the positions of the light-receiving board 151 and fixed board 156 from being displaced from each other at the time of screwing them. As a result, also in the detection unit 152, it is possible to reduce the time for position adjustment between the optical axis of the reflected light 140*a* and BD 150. Further, the adjustment tools 131 and 132 used for the position adjustment operation in the light source unit 120 and detection unit 152 are less expensive than the precision stage which has conventionally been necessary for the position adjustment, thereby reducing cost of the adjustment tool.

Figure 13:
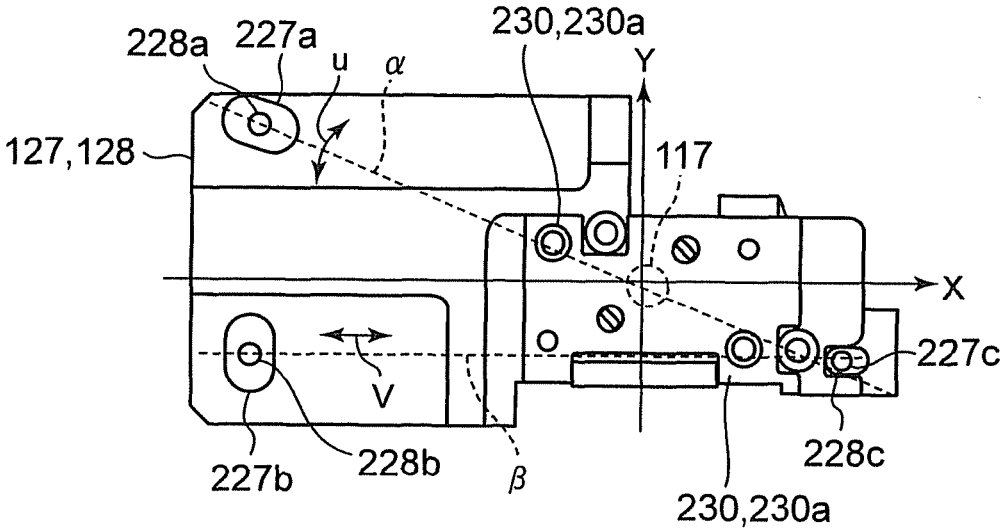
FIG. 13 is an explanatory view showing the movement direction of a board holder and a lens holder according to the second embodiment of the present invention.

A second embodiment of the present invention will next be described. The second embodiment is the same as the first embodiment except for the positions of the elongated and circular holes for position adjustment, so that the same reference numerals as the first embodiment are given to the same components which are common to the first embodiment, and the overlapped description is omitted. In the second embodiment, as shown in FIG. 13, an elongated hole for restriction 227*c* and a positioning pin 228*c* are disposed below the laser diode 117. The long side of the elongated hole for restriction 227*c* extends on the dotted line β parallel to the X-axis direction which is a first direction. The elongated hole for restriction 227*c* and positioning pin 228*c* are relatively movable with respect to each other in the X-axis direction.

In the board holder 127, a fourth elongated hole 227*a*, which is an elongated hole for rotation movement and whose long side extends in parallel to a center line α is formed at the position on the extension of the center line a connecting the centers of the positioning pin 228*c* and laser diode 117. In the board holder 127, a fifth elongated hole 227*b* which is an elongated hole for slide movement is formed at the position on the extension of a dotted line β of FIG. 13. The fifth elongated hole 227*b* is formed such that its short side is parallel to the dotted line β.

In the lens holder 128, a fourth circular hole 228*a* which is a circular hole for rotation movement and a fifth circular hole 228*b* which is a circular hole for slide movement are formed. When the board holder 127 and lens holder 128 are overlapped with each other, the fourth circular hole 228*a* and fifth circular hole 228*b* face the fourth elongated hole 227*a* and fifth elongated hole 227*b*, respectively.

Figure 12:
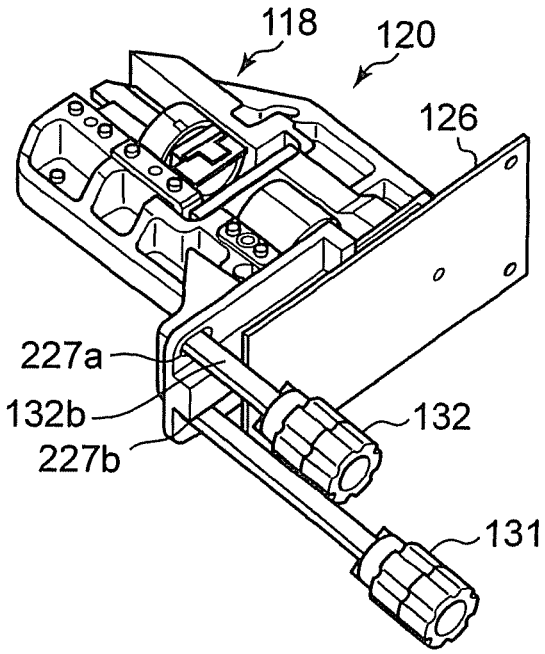
FIG. 12 is a perspective view schematically showing a state where the adjustment tool has been inserted into the light source unit according to the second embodiment of the present invention.

At the position adjustment operation time, the same adjustment tools as those used in the first embodiment are used. After the positioning pin 228*c* is inserted through the elongated hole for restriction 227*c*, the second and first adjustment tools 132 and 131 are inserted into the fourth elongated hole 227*a* and fifth elongated hole 227*b* respectively, as shown in FIG. 12. When the second adjustment tool 132 is rotated, the eccentric cam 132*b* is brought into contact with the side of the fourth elongated hole 227*a*. As a result, the board holder 127 and lens holder 128 are relatively rotated about the positioning pin 228*c* with respect to each other in the directions of arrow u shown in FIG. 13.

On the other hand, when the first adjustment tool 131 is rotated, the eccentric cam 131*b* is brought into contact with the side of the fifth elongated hole 227*b*. As a result, the board holder 127 and lens holder 128 are relatively moved with respect to each other in the directions along X-axis which are denoted by arrow v shown in FIG. 13. The rotational operation of the first and second adjustment tools 131 and 132 may be performed alternately or simultaneously.

The first and second adjustment tools 131 and 132 are rotated as described above to thereby establish alignment between the optical axes of the laser diode 117 and lens system 118. After the alignment between the optical axes of the laser diode 117 and lens system 118 has been established, screws 230*a* are tightened in screw holes 230 to thereby fix the board holder 127 and lens holder 128 together. In this state, the positional relationship between the board holder 127 and lens holder 128 is determined by three points: the positioning pin 228*c*, first adjustment tool 131, and second adjustment tool 132, thereby completing the screwing operation quickly.

As is the case with the first embodiment, according to the second embodiment, in a state where the board holder 127 and lens holder 128 are joined to each other, the second adjustment tool 132 is inserted into the fourth elongated hole 227*a* and is rotated therein. As a result, the board holder 127 and lens holder 128 are relatively rotated about the positioning pin 228*c* with respect to each other. Further, the first adjustment tool 131 is inserted into the fifth elongated hole 227*b* and is rotated therein. As a result, the board holder 127 and lens holder 128 are relatively moved with respect to each other in the directions along X-axis. When the optical axes of the laser diode 117 and lens system 118 are aligned with each other, the board holder 127 and lens holder 128 are fixed together. In this state, the positional relationship between the board holder 127 and lens holder 128 is determined by three points. This prevents the positions of the board holder 127 and lens holder 128 from being displaced at the time of screwing them, thereby completing the screwing operation quickly. As a result, it is possible to reduce the time needed for the adjustment and fixation of the optical axis of the light source unit 120. Further, as in the case of the first embodiment, there is no need to form a hole for adjustment in the circuit board 126 at the position in the vicinity of the laser diode 117. This eliminates the limitation on the design of the drive circuit of the laser diode 117, thereby increasing design flexibility. Further, cost of the adjustment tool can be reduced.

The present invention is not limited to the above embodiment but various modifications can be made within the scope of the present invention. For example, the shapes of the light source board, lens board, light-receiving board, and fixed board are not limited, and the sizes of the elongated holes and circular holes can be arbitrarily set depending on the size or the like of the adjustment tool. Further, as long as opposing boards can relatively be moved with respect to each other about a restricting member, the positions or arrangement directions of the elongated holes and circular holes can be arbitrarily set, and the shapes of the elongated holes are not limited to an ellipse or rectangular shape. Further, the number of the light source units to be mounted in the laser exposure device is not limited.

What is claimed is:

1. An image forming apparatus, comprising:

an image forming unit configured to develop a formed electrostatic latent image on an image carrier, and form a toner image on the image carrier;

a laser exposure unit to expose the image carrier, having a laser light source, a lens system which guides laser light emitted from the laser light source to a predetermined position, a light source board which supports the laser light source, a lens board which supports the lens system, a restricting member which joins the light source board and lens board such that they can relatively be moved with respect to each other in a first direction, an elongated hole for rotation movement which is formed in the light source board or lens board at the position on the extension of the center line connecting the center of the restricting member and that of the laser light source and whose long side extends in parallel to the center line, a circular hole for rotation movement which is formed in the light source board or lens board at the position facing the elongated hole for rotation movement and whose diameter is smaller than the length of the short side of the elongated hole for rotation movement, an elongated hole for slide movement which is formed in the light source board or lens board and whose short side extends along the first direction and a circular hole for slide movement which is formed in the light source board or lens board at the position facing the elongated hole for slide movement and whose diameter is smaller than the length of the short side of the elongated hole for slide movement;

a transfer unit to transfer the toner image on the image carrier to a recording medium; and a fixing unit to fix the toner image on the image carrier.

2. The apparatus to claim 1, wherein the restriction member includes an elongated hole for restriction which is formed in the light source board or lens board and whose long side extends in parallel to the first direction and a positioning pin which is formed in the light source board or lens board at the position facing the elongated hole for restriction, which has a diameter corresponding to the length of the short side of the elongated hole for restriction, and which is inserted through the elongated hole for restriction.

3. The apparatus according to claim 1, wherein when a first eccentric cam is inserted through the elongated hole for rotation movement and is rotated about the circular hole for rotation movement, the light source board and lens board are relatively moved with respect to each other in the rotation direction about the restricting member.

4. The apparatus according to claim 1, wherein when a second eccentric cam is inserted through the elongated hole for slide movement and is rotated about the circular hole for slide movement, the light source board and lens board are relatively moved with respect to each other along the first direction.

5. The apparatus according to claim 1, wherein when the first and second eccentric cams are inserted respectively through the elongated hole for rotation movement and the elongated hole for slide movement and rotated respectively about the circular hole for rotation movement and circular hole for slide movement, the light source board and lens board are relatively moved with respect to each other in the rotation direction about the restricting member and, at the same time, relatively moved with respect to each other along the first direction.

6. The apparatus according to claim 1, wherein the long side of the elongated hole for rotation movement extends in parallel to the first direction, and the long side of the elongated hole for slide movement extends in the direction crossing the first direction.

7. The apparatus according to claim 6, wherein the long side of the elongated hole for slide movement extends in the direction crossing at right angles the first direction.

8. An image forming apparatus, comprising:

an image forming unit configured to develop a formed electrostatic latent image on an image carrier, and form a toner image on the image carrier;

a laser exposure unit to expose the image carrier, having a laser light source, a lens system which guides laser light emitted from the laser light source to a laser receiving element, a light-receiving board which supports the laser receiving element, a fixed board fixed to a unit main body, a restricting member which joins the light-receiving board and fixed board such that they can relatively be moved with respect to each other in a first direction, an elongated hole for rotation movement which is formed in the light-receiving board or fixed board at the position on the extension of the center line connecting the center of the restricting member and that of the laser receiving element and whose long side extends in parallel to the center line, a circular hole for rotation movement which is formed in the light-receiving board or fixed board at the position facing the elongated hole for rotation movement and whose diameter is smaller than the length of the short side of the elongated hole for rotation movement, an elongated hole for slide movement which is formed in the light-receiving board or fixed board and whose short side extends along the first direction and a circular hole for slide movement which is formed in the light-receiving board or fixed board at the position facing the elongated hole for slide movement and whose diameter is smaller than the length of the short side of the elongated hole for slide movement;

a transfer unit to transfer the toner image on the image carrier to a recording medium; and a fixing unit to fix the toner image on the image carrier.

9. The apparatus according to claim 8, wherein the restriction member includes an elongated hole for restriction which is formed in the light-receiving board or fixed board and whose long side extends in parallel to the first direction and a positioning pin which is formed in the light-receiving board or fixed board at the position facing the elongated hole for restriction, which has a diameter corresponding to the length of the short side of the elongated hole for restriction, and which is inserted through the elongated hole for restriction.

10. The apparatus according to claim 8, wherein when a first eccentric cam is inserted through the elongated hole for rotation movement and is rotated about the circular hole for rotation movement, the light-receiving board and fixed board are relatively moved with respect to each other in the rotation direction about the restricting member.

11. The apparatus according to claim 8, wherein when a second eccentric cam is inserted through the elongated hole for slide movement and is rotated about the circular hole for slide movement, the light-receiving board and fixed board are relatively moved with respect to each other along the first direction.

12. The apparatus according to claim 8, wherein when the first and second eccentric cams are inserted respectively through the elongated hole for rotation movement and the elongated hole for slide movement and rotated respectively about the circular hole for rotation movement and circular hole for slide movement, the light-receiving board and fixed board are relatively moved with respect to each other in the rotation direction about the restricting member and, at the same time, relatively moved with respect to each other along the first direction.

13. The apparatus according to claim 8, wherein the long side of the elongated hole for rotation movement extends in parallel to the first direction, and the long side of the elongated hole for slide movement extends in the direction crossing the first direction.

14. The apparatus according to claim 13, wherein the long side of the elongated hole for slide movement extends in the direction crossing at right angles the first direction.

15. An optical axis of laser light adjustment method in an image forming apparatus which uses a lens system to guide laser light emitted from a laser light source and to expose an image carrier, to a predetermined position, the image forming apparatus including: a first board which is integrated with the lens system; and a second board which supports the laser light source or a laser receiving element provided in the predetermined position, which is joined to the first board through a restricting member, and which can relatively be moved with respect to the first board, the image forming apparatus further including: an elongated hole for rotation movement which is formed in the first board or second board at the position on the extension of the center line connecting the center of the restricting member and that of the laser light source or that of the laser receiving element and whose long side extends in parallel to the center line; a circular hole for rotation movement which is formed in the first board or second board at the position facing the elongated hole for rotation movement and whose diameter is smaller than the length of the short side of the elongated hole for rotation movement; an elongated hole for slide movement which is formed in the first board or second board and whose short side extends along the slide movement direction; and a circular hole for slide movement which is formed in the first board or second board at the position facing the elongated hole for slide movement and whose diameter is smaller than the length of the short side of the elongated hole for slide movement, the method comprising:

a rotation movement step of rotating a first eccentric cam fitted into the elongated hole for rotation movement about the circular hole for rotation movement to relatively move the first and second boards with respect to each other in the rotation direction about the restricting member; and a parallel movement step of rotating a second eccentric cam fitted into the elongated hole for slide movement about the circular hole for slide movement to relatively move the first and second boards with respect to each other in the slide direction defined by the restricting member.

16. The method according to claim 15, wherein the restriction member includes an elongated hole for restriction which is formed in the first board or second board and whose long side extends in parallel to the slide movement direction and a positioning pin which is formed in the first board or second board at the position facing the elongated hole for restriction, which has a diameter corresponding to the length of the short side of the elongated hole for restriction, and which is inserted through the elongated hole for restriction.

17. The method according to claim 15, wherein after the completion of the rotation movement step and parallel movement step, the first and second boards are fixed to each other in a state where the first eccentric cam is fitted into the elongated hole for rotation movement and second eccentric cam is fitted into the elongated hole for slide movement.

18. The method according to claim 15, wherein the rotation movement step and parallel movement step are performed simultaneously.

19. The method according to claim 15, wherein the second board supports the laser light source.

20. The method according to claim 15, wherein the second board supports the laser receiving element.

* * * * *